US010869126B2

(12) United States Patent
Christoph et al.

(10) Patent No.: US 10,869,126 B2
(45) Date of Patent: Dec. 15, 2020

(54) SOUND CAPTURING

(71) Applicant: Harman Becker Automotive Systems GmbH, Karlsbad (DE)

(72) Inventors: Markus Christoph, Straubing (DE); Gerhard Pfaffinger, Regensburg (DE); Matthias Kronlachner, Regensburg (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 0 days.

(21) Appl. No.: 16/617,480

(22) PCT Filed: May 3, 2018

(86) PCT No.: PCT/EP2018/061303

§ 371 (c)(1),
(2) Date: Nov. 26, 2019

(87) PCT Pub. No.: WO2018/219582

PCT Pub. Date: Dec. 6, 2018

(65) Prior Publication Data

US 2020/0145754 A1 May 7, 2020

(30) Foreign Application Priority Data

May 29, 2017 (EP) ..... 17173283
Jun. 27, 2017 (EP) ..... 17178150

(51) Int. Cl.
*H04R 3/00* (2006.01)
*G10L 21/0232* (2013.01)
(Continued)

(52) U.S. Cl.
CPC ..... *H04R 3/005* (2013.01); *G10L 21/0232* (2013.01); *H04R 1/406* (2013.01);
(Continued)

(58) Field of Classification Search
CPC .... H04R 3/005; H04R 1/406; H04R 2410/01; G10L 21/0232; G10L 2021/02082; G10L 2021/02166
See application file for complete search history.

(56) References Cited

U.S. PATENT DOCUMENTS 9,928,847 B1 * 3/2018 Cleve ..... H04R 1/406
10,062,379 B2 * 8/2018 Katuri ..... G10L 15/20
(Continued)

FOREIGN PATENT DOCUMENTS

EP 0869697 A2 10/1998
EP 1538867 A1 6/2005
(Continued)

OTHER PUBLICATIONS

Gómez, P. et al., "Multiple source separation in the frequency domain using Negative Beamforming," Proceedings of the 7th European Conference on Speech Communication and Technology, Sep. 3, 2001, Aalborg, Denmark, 2 pages.
(Continued)

*Primary Examiner* — Andrew L Sniezek
(74) *Attorney, Agent, or Firm* — McCoy Russell LLP

(57) ABSTRACT

Sound capturing which includes applying a far-field microphone functionality to a multiplicity of first microphone signals to provide a first output signal, and applying a less directional microphone functionality to one or more second microphone signals to provide a second output signal.

20 Claims, 7 Drawing Sheets

(51) Int. Cl.
*H04R 1/40* (2006.01)
*G10L 21/0208* (2013.01)
*G10L 21/0216* (2013.01)

(52) U.S. Cl.
CPC ..... *G10L 2021/02082* (2013.01); *G10L 2021/02166* (2013.01); *H04R 2410/01* (2013.01)

(56) References Cited

U.S. PATENT DOCUMENTS

| | | | | |
|---|---|---|---|---|
| 2007/0053455 | A1 | 3/2007 | Sugiyama | |
| 2009/0304200 | A1* | 12/2009 | Kim | G10K 11/178 381/71.11 |
| 2014/0350935 | A1 | 11/2014 | Schuster et al. | |
| 2016/0241955 | A1 | 8/2016 | Thyssen et al. | |
| 2018/0330747 | A1* | 11/2018 | Ebenezer | G10L 25/84 |

FOREIGN PATENT DOCUMENTS

| | | | |
|---|---|---|---|
| EP | 2437517 | A1 | 4/2012 |
| JP | 2007147732 | A | 6/2007 |
| WO | 2010019192 | A1 | 2/2010 |

OTHER PUBLICATIONS

ISA European Patent Office, International Search Report and Written Opinion Issued in Application No. PCT/EP2018/061303, dated Sep. 3, 2018, WIPO, 25 pages.

* cited by examiner

SOUND CAPTURING

CROSS-REFERENCE TO RELATED APPLICATIONS

The present application is a U.S. National Phase of International Patent Application Serial No. PCT/EP2018/061303 entitled "SOUND CAPTURING," filed on May 3, 2018. International Patent Application Serial No. PCT/EP2018/061303 claims priority to European Patent Application No. 17173283.7 filed on May 29, 2017 and European Patent Application No. 17178150.3 filed on Jun. 27, 2017. The entire contents of each of the above-referenced applications are hereby incorporated by reference for all purposes.

TECHNICAL FIELD

The disclosure relates to a system and method (generally referred to as a "system") for capturing sound.

BACKGROUND

Far field microphone systems are often used as a front end of speech recognition engines (SRE) such as Cortana® (by Microsoft), Alexa® (by Amazon), Siri® (by Apple), Bixby® (by Samsung) or the like, and are, in this regard, also used to spot or detect keywords, such as "Alexa", "Hey Cortana" and so on. Common far field microphones have, for example, a steerable and highly directional sensitivity characteristic and may include a multiplicity (e.g., an array) of microphones whose output signals are processed in a signal processing path including any sort of beamforming structure to form a beam-shaped sensitivity characteristic of the array of microphones. The beam-shaped sensitivity characteristic (herein referred to as beam) increases the signal-to-noise ratio (SNR) and, thus, may allow to pick up speech spoken at a greater distance from the multiplicity of microphones.

Usually the position of a person who talks (i.e., a talker) and, thus, the direction from which speech emerges, is not known. However, for a maximum signal-to-noise ratio the beam-shaped sensitivity characteristic of the multiplicity of microphones needs to be steered to the position of the talker who may be located at any horizontal angle (360° coverage) around the multiplicity of microphones. In addition, the talker may change so that the beamforming structure has to be able to act on any speech signal from any direction. Furthermore, far field microphone systems may be placed in any environment, such as, e.g., a living room where an active television set or a radio is close by, or a cafeteria where many people are talking in connection with noise from very different sounding, widely scattered sound sources. In such scenarios it is very likely that the beamforming structure will be distracted, for example by the sound generated by an active television set, i.e., the beam may be steered towards the television set while the talker would like to activate the speech recognition engine by using the corresponding keyword. If the beamforming structure is too slow to track the talker, this may lead to an unrecognized keyword, forcing the talker to repeat the keyword (over and over), which may be annoying for the talker.

SUMMARY

An example sound capturing system includes a first signal processing path configured to apply a far-field microphone functionality based on a multiplicity of first microphone signals and to provide a first output signal, and a second signal processing path configured to apply a less directional microphone functionality based on one or more second microphone signals and to provide a second output signal.

An example sound capturing method includes applying a far-field microphone functionality to a multiplicity of first microphone signals to provide a first output signal, and applying a less directional microphone functionality to one or more second microphone signals to provide a second output signal.

Other systems, methods, features and advantages will be, or will become, apparent to one with skill in the art upon examination of the following detailed description and appended figures. It is intended that all such additional systems methods, features and advantages be included within this description, be within the scope of the invention, and be protected by the following claims.

BRIEF DESCRIPTION OF THE DRAWINGS

The system and method may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
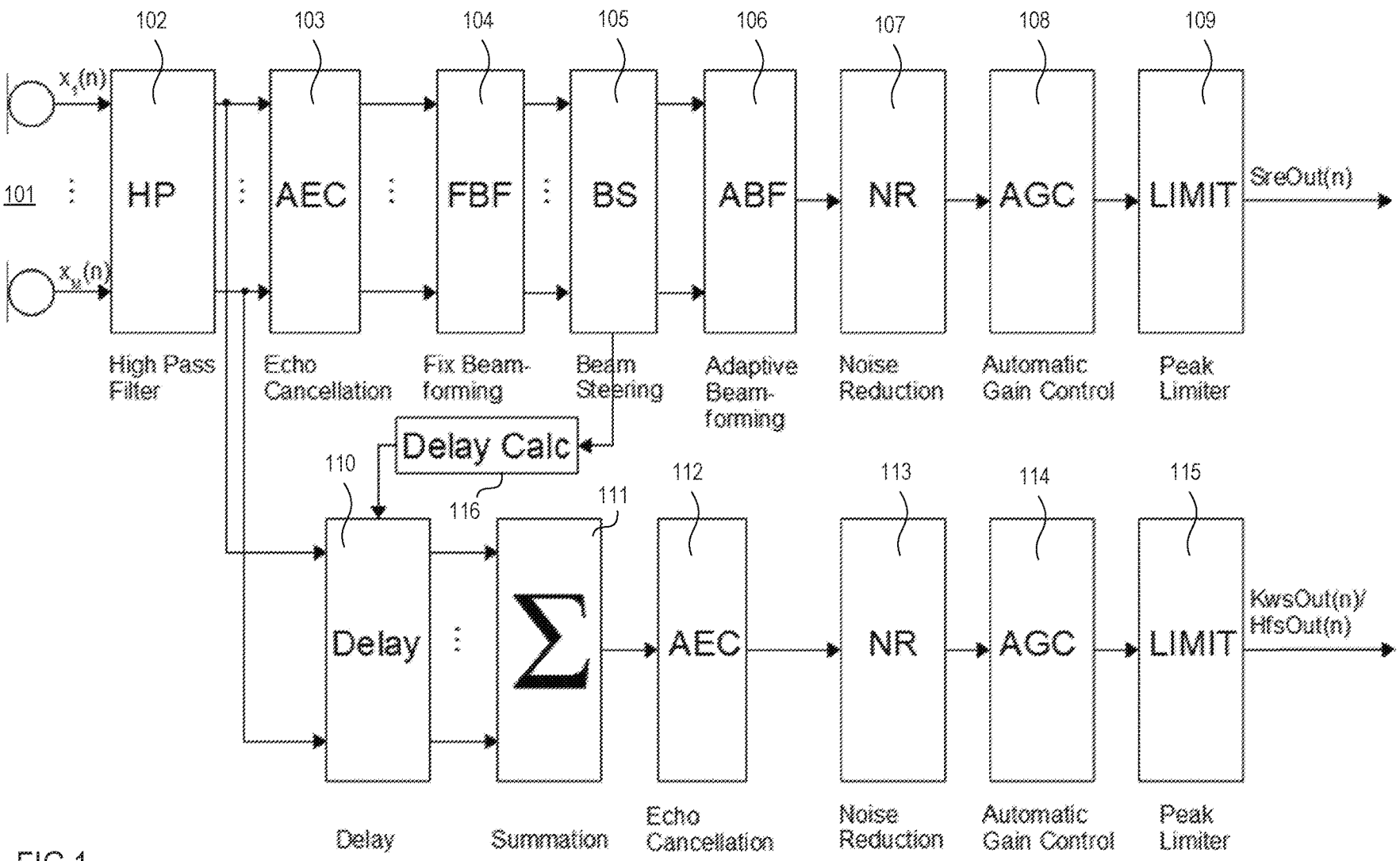
FIG. 1 is a schematic diagram illustrating an exemplary sound capturing system with a first signal and second signal processing path, the second signal processing path including a delay-and-sum block.

In the exemplary sound capturing systems described below, in addition to one (first) signal processing path with a far-field microphone functionality a (second) signal processing path with an omnidirectional or other less directional microphone functionality is provided. For example, the second signal processing path may operate in connection with at least one additional omnidirectional microphone or one or more already existing microphones such as the microphones of the array of microphones (also referred to as microphone array or, simply, array) used in connection with the first signal processing path.

In one example, the output signals of all microphones of the microphone array already utilized in connection with the first signal processing path are summed up in the second signal processing path. The resulting sum signal contains less noise than the output signal of a single microphone of the array by a noise reduction factor RN, which is RN [dB]=10·log 10 (number of microphones) and, thus, provides an improved white noise gain.

Just summing up the output signals of the (e.g., omnidirectional) microphones of the array causes a significant deterioration of the magnitude frequency response of the sum signal. For example, the deterioration depends on the geometry of the array, i.e. the (inter) distance between the microphones of the microphone array. To overcome this drawback, a delay and sum beamforming structure may be employed in which the output signals of the microphones are delayed before they are summed up, and in which the delays can be adapted (controlled) such that the beam may be steered to a desired direction. The delays may include fractional delays, i.e., delaying sampled data by a fraction of a sample period.

Another way to overcome the backlog outlined above is to insert, between microphones and summation point, (instead of delays) allpass filters with cut-off frequencies that are arranged around a notch in the resulting magnitude frequency response with randomly distributed cut-off frequencies and, as the case may be, randomly distributed quality values, in order to obtain a diffuse phase characteristic around the notch frequency so that the notch in the magnitude frequency response, after summation, is closed in a way which is almost independent from the angle of incidence. As a result, a virtual omnidirectional microphone can be obtained with an improved noise behavior, whose output signal then may form the input to subsequent parts of the second signal processing path including, e.g., acoustic echo canceling, noise reduction, automatic gain control, limiting, etc.

Alternatively, the output signals of automatic echo cancelers in the first signal processing path may be used as input signal(s) for the allpass filter(s) in the second signal processing path. In another alternative, the microphone signals are allpass filtered and then summed up. The sum signal is then supplied to a single channel automatic echo canceler upstream of the rest of the first signal processing path.

Referring now to FIG. 1, an exemplary sound capture system includes a multiplicity (e.g., an array) of microphones 101 and an optional multi-channel high-pass (HP) filter block 102. The sound capture system further includes a subsequent multi-channel acoustic echo cancellation (AEC) block 103 connected downstream of the optional high-pass filter block 102, a subsequent fixed beamformer (FBF) block 104, a subsequent beam steering (BS) block 105, an adaptive beamforming (ABF) block 106, a subsequent noise reduction (NR) block 107, an automatic gain control (AGC) block 108, and a (peak) limiter block 109. The blocks 102-109 are included in a first signal processing path that, in connection with microphones 101, forms an exemplary far-field microphone system.

The optional multi-channel high-pass filter block 102 includes a multiplicity of high-pass filters that are each connected downstream (e.g., to an output) of one of the multiplicity of microphones 101. The high-pass filters may be configured to cut off lower frequencies (e.g., below 150 Hz) that are not relevant for speech processing but may contribute to the overall noise.

The multi-channel acoustic echo cancellation block 103 includes a multiplicity of acoustic echo cancelers that are each connected downstream (e.g., to an output) of one of the multiplicity of high-pass filters in high-pass filter block 102 and, thus, coupled with the microphones 101. Echo cancellation involves first recognizing in a signal from a microphone the originally transmitted signal that re-appears, with some delay, as an echo in the signal received by this microphone. Once the echo is recognized, it can be removed by subtracting it from the transmitted and received signal to provide an echo suppressed signal.

Output signals of acoustic echo cancellation block 103 serve as input signals to the fix beamforming block 104 which may employ a simple yet effective (beamforming) technique, such as the delay-and-sum (DS) technique. A simple structure of a fix delay-and-sum structure may be such that the high-pass filtered and echo suppressed microphone output signals are delayed relative to each other and then summed up to provide output signals of the fix beamforming block 104.

The beam steering block 105 may deliver one output signal which represents a beam pointing in a direction in a room (room direction) with currently the highest signal-to-noise ratio, referred to as positive beam, and another output signal which represents a beam pointing in a direction in a room (room direction) with, e.g., currently the lowest signal-to-noise ratio, referred to as negative beam. Based on these two signals, the adaptive beamforming block 106, which is operatively connected downstream (e.g., to outputs) of the beam steering block 105, provides at least one output signal which ideally solely contains useful signal parts (such as speech signals) but no or only minor noise parts, and may provide another output signal which ideally solely contains noise.

The adaptive beamforming block 106 may be configured to perform adaptive spatial signal processing on the preprocessed signals from the microphones 101. These signals are combined in a manner which increases the signal strength from a chosen direction. Signals from other directions may be combined in a benign or destructive manner, resulting in degradation of the signal from the undesired direction. The output signal of the adaptive beamforming block 106 provides an output signal with improved signal-to-noise ratio.

The noise reduction block 107 may be configured to remove residual noise from the signal provided by the adaptive beamforming block 106, e.g., using common audio noise removal techniques.

The automatic gain control block 108 may have a closed-loop feedback regulating structure and may be configured to provide a controlled signal amplitude at its output, despite variation of the amplitude in its input signal. The average or peak output signal level may be used to dynamically adjust the input-to-output gain to a suitable value, enabling the subsequent signal processing structure to work satisfactorily with a greater range of input signal levels.

The (peak) limiter block 109 may be configured to execute a process by which a specified characteristic (e.g., amplitude) of a signal, which is here the signal output by the automatic gain control block 108, is prevented from exceeding a predetermined value, i.e., to limit the signal amplitude to the predetermined value. The (peak) limiter block 109 provides a signal SreOut(n) which may serve as an output signal of the first signal processing path and as an input signal for a speech recognition engine (not shown).

The sound capturing system shown in FIG. 1 further includes a second signal processing path which may be connected to a separate dedicated omnidirectional microphone (not shown) or a separate dedicated array of microphones (not shown) with omnidirectional directivity characteristics. However, in the sound capturing system shown in FIG. 1, the already existing array of microphones 101 and the subsequent high-pass filter block 102 form not only the front end for the first signal processing path but also for the second signal processing path. The exemplary second signal processing path includes a multi-channel delay block 110, a subsequent summing block 111, a subsequent single-channel acoustic echo cancellation (AEC) block 112, a subsequent noise reduction (NR) block 113, an automatic gain control (AGC) block 114, and a (peak) limiter block 115. The delay block 110 may be controlled by the beam steering block 105 of the first signal processing path via a delay calculation block 116.

Before the output signals from the high-pass filter block 102, i.e., the filtered output signals of microphones 101, are summed up by summing block 111, multi-channel delay block 110 delays the output signals from the high-pass filter block 102 with different delays that may be controlled by the beam steering block 105 of the first signal processing path via the delay calculation block 116. The delays of the delay block 110 are controlled so that the directivity characteristic of the array of microphones 101 as represented by an output signal of the summing block 111 is, for example, (approximately) omnidirectional or has any other less directional shape.

The single-channel acoustic echo cancellation block 112 includes an acoustic echo canceler that is connected downstream (e.g., to an output) of summing block 111. The acoustic echo canceler may operate in the same or similar manner as the multiplicity of acoustic echo cancelers employed in the multi-channel acoustic echo cancellation block 103. Further, noise reduction block 113, automatic gain control block 114, and (peak) limiter block 115 in the second signal processing path may have identical or similar structures and/or functionalities as noise reduction block 107 automatic gain control block 108, and (peak) limiter block 109 in the first signal processing path. The (peak) limiter block 115 provides a signal KwsOut(n), which may serve as an output signal of the second signal processing path and as an input signal for a speech processing arrangement, e.g., a keyword search system (not shown), and/or a signal HfsOut (n), which may serve as (another) output signal of the second signal processing path and as input signal for a speech processing arrangement, e.g., a hands-free system (not shown). Speech processing may include any appropriate processing of signals containing speech signals from simple processing of characteristics such as telephone signals on one end to sophisticated speech recognition on the other end.

Figure 2:
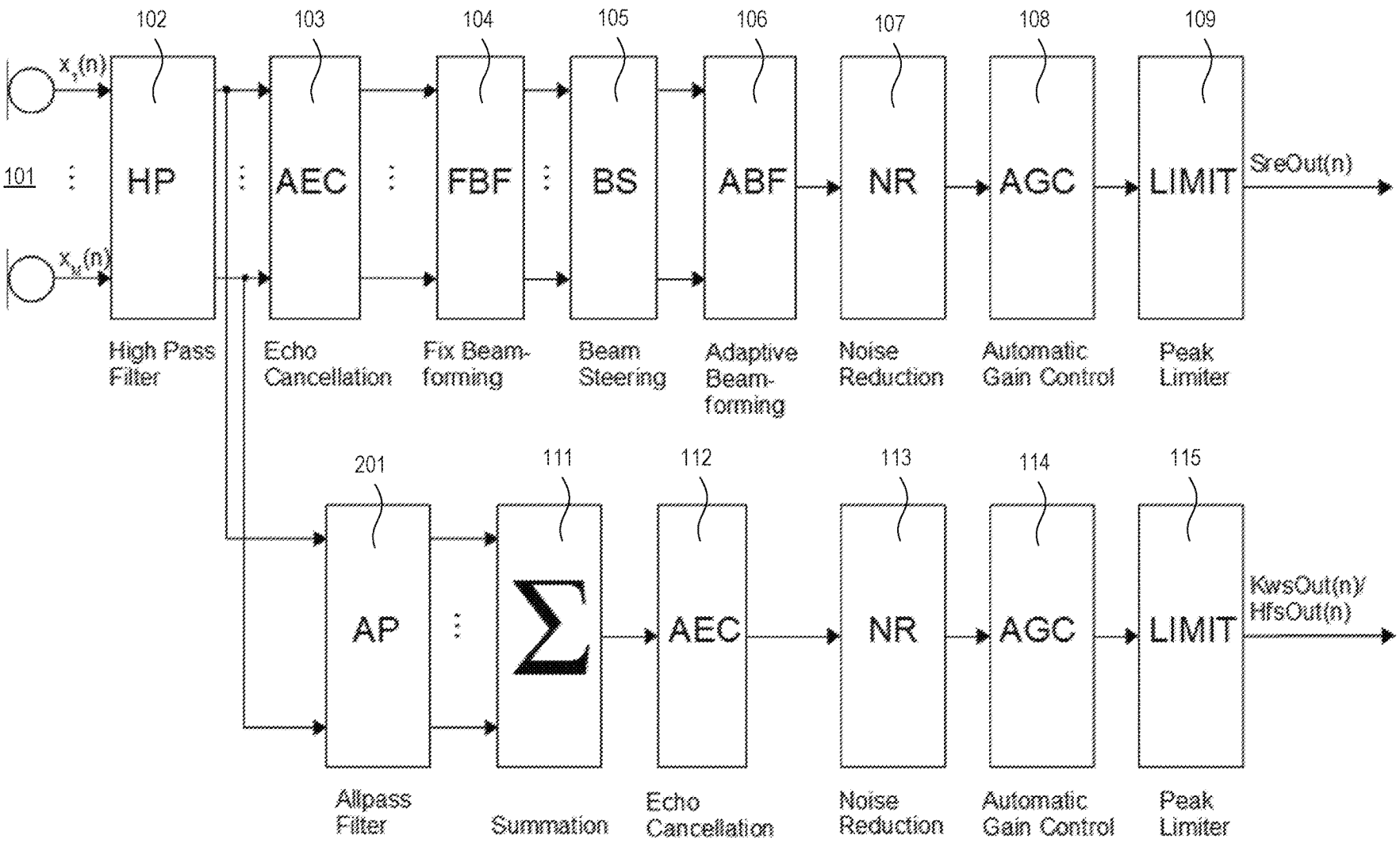
FIG. 2 is a schematic diagram illustrating another exemplary sound capturing system, the system including an allpass filter block in the 5 second signal processing path and separate acoustic echo cancelers in the first signal processing path and second signal processing path.

Referring to FIG. 2, the system shown in FIG. 1 may be altered by omitting the delay calculation block 116 and substituting the multi-channel delay block 110 by a multi-channel allpass filter block 201. The allpass filter block 201 includes a multiplicity of allpass filters that are each connected downstream (e.g., to an output) of one of the multiplicity of high-pass filters and, thus, coupled with the microphones 101. The allpass filters have cut-off frequencies that are arranged around a notch in a resulting magnitude frequency response with randomly distributed cut-off frequencies and optionally also with randomly distributed quality values, in order to gain a diffuse phase characteristic around the notch frequency, so that the notch in the magnitude frequency response, after summation in summing block 11, is closed in a way which is almost independent from the angle of incidence.

Figure 3:
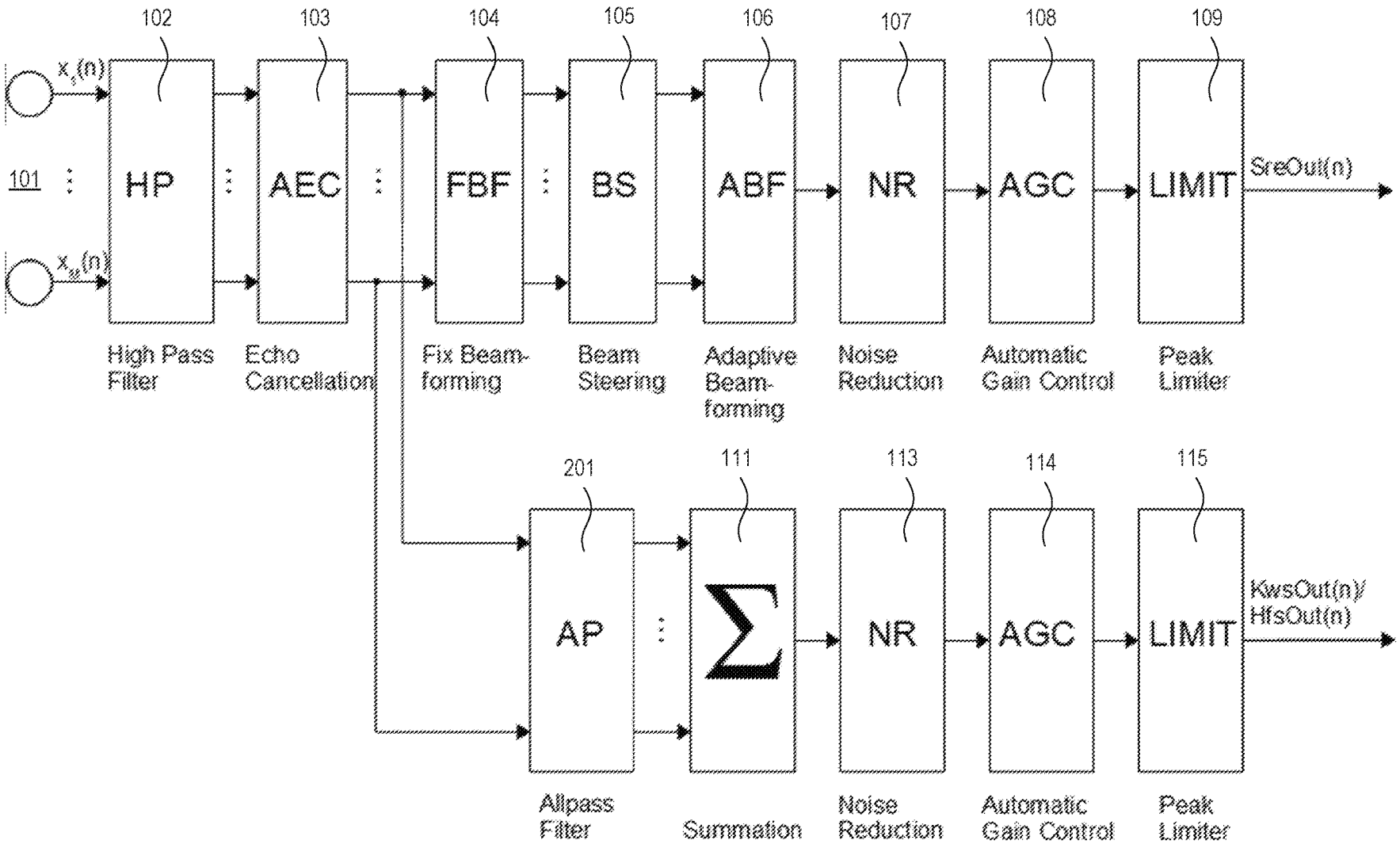
FIG. 3 is a schematic diagram illustrating another exemplary sound capturing system, the system including an allpass filter block in the second signal processing path and a common acoustic echo canceler block in the first signal processing path and second signal processing path.

Referring to FIG. 3, the system shown in FIG. 2 may be altered by omitting the single-channel acoustic echo cancellation block 112 and connecting the noise reduction block 113 directly to the summing block 111, and connecting the allpass filter block 201 to outputs of the multi-channel acoustic echo cancellation block 103 instead of the high-pass filter block 102. This allows to reduce the complexity of the second signal processing path and, thus, the complexity of the whole system.

Figure 4:
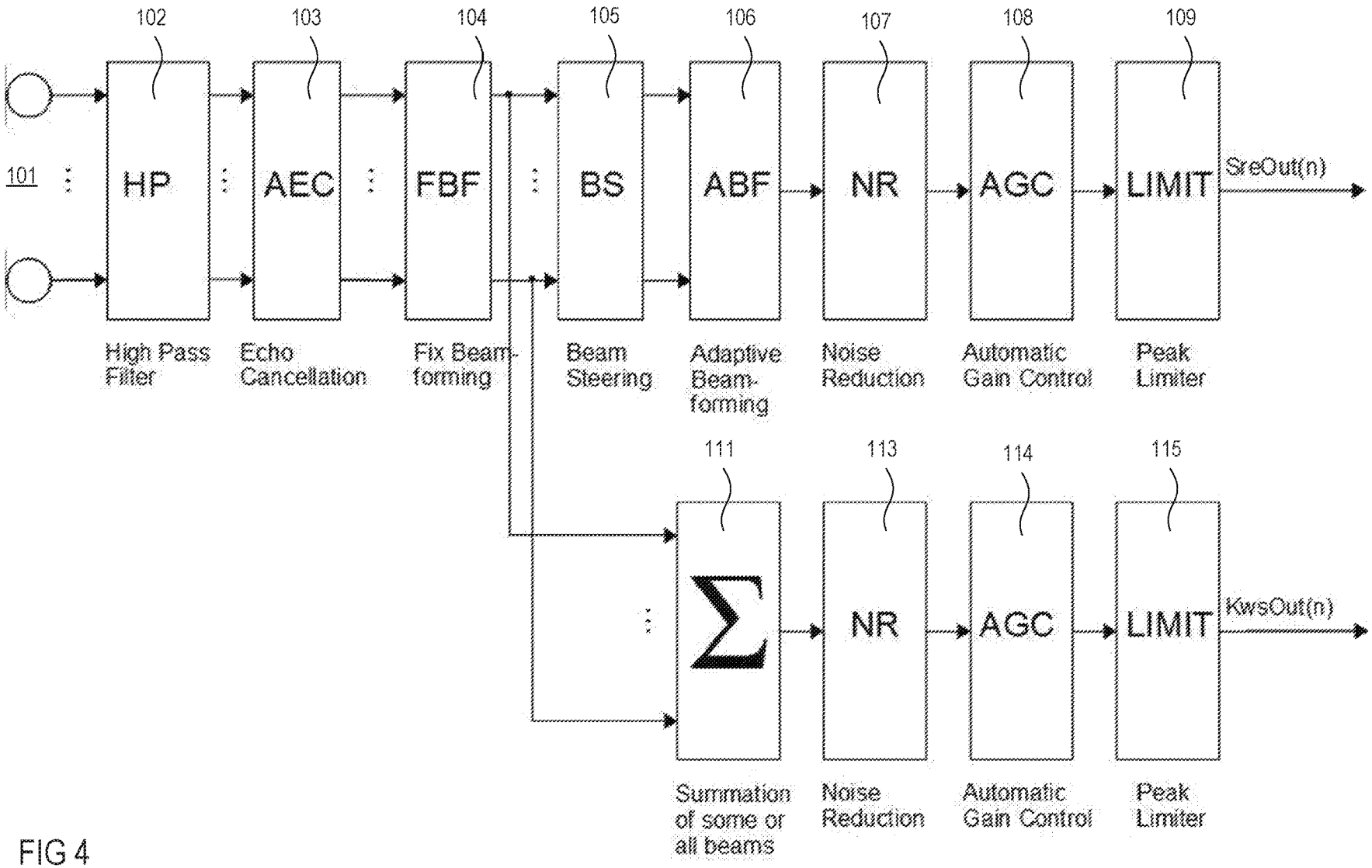
FIG. 4 is a schematic diagram illustrating another exemplary sound capturing system, the system including a common fix beamforming block for the first signal processing path and second signal processing path.
Figure 5:
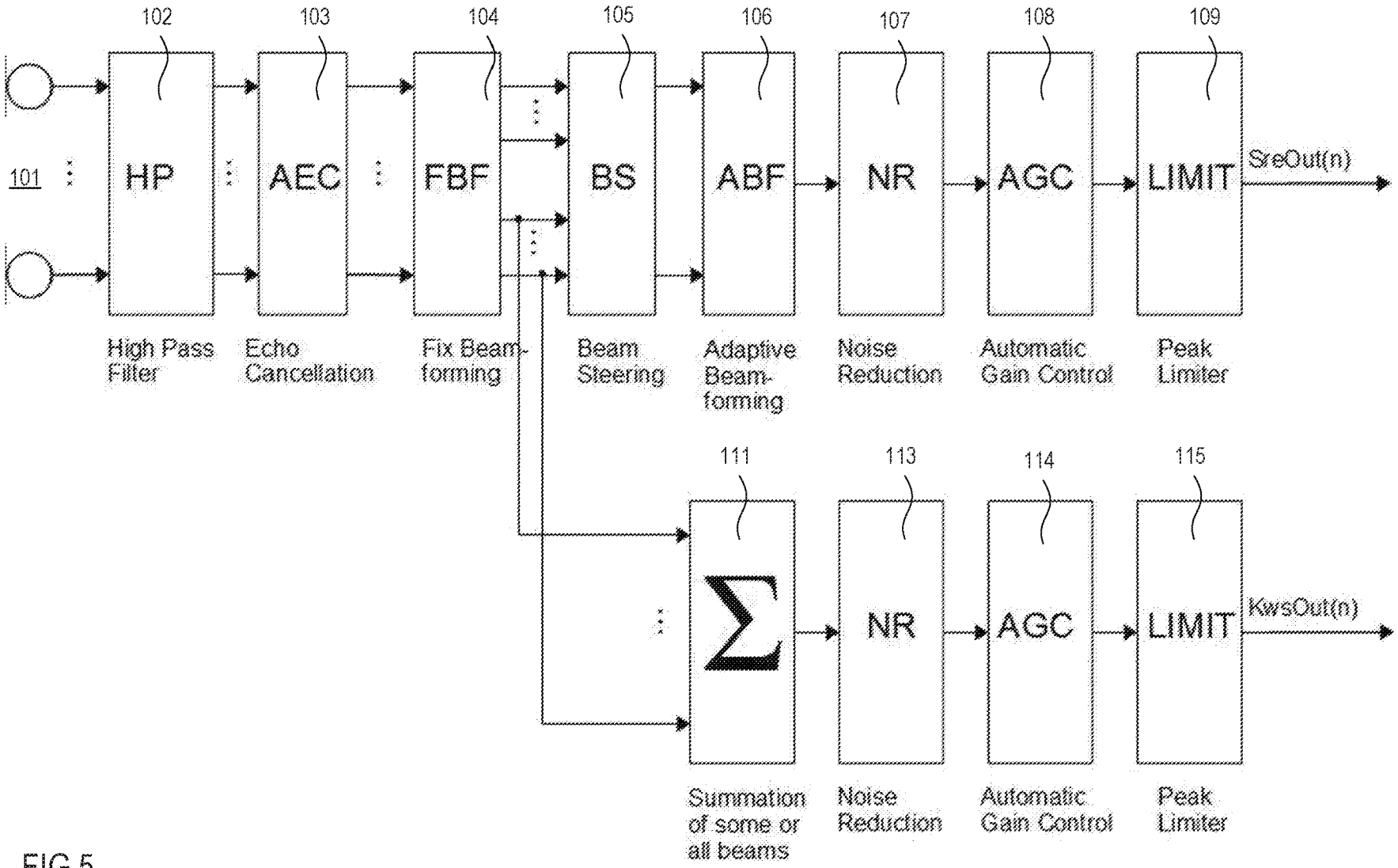
FIG. 5 is a schematic diagram illustrating the system shown in FIG. 4 in which only outputs of the common fix beamforming block that relate to the more negative beams are processed in the second signal processing path.
Figure 6:
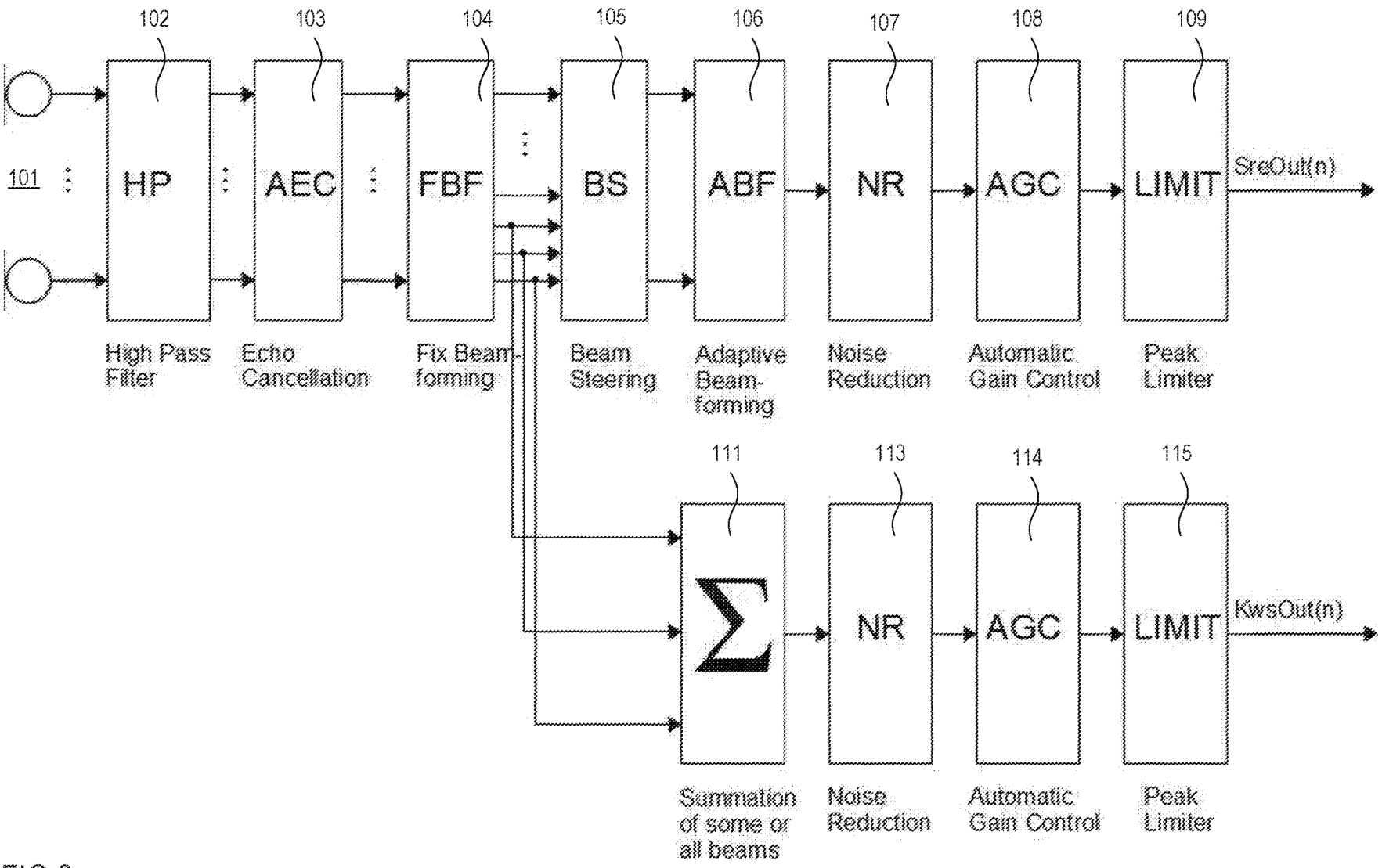
FIG. 6 is a schematic diagram illustrating the system shown in FIG. 4 in which only the output of the common fix beamforming block that relates to the most negative beam and one neighboring beam on each side thereof are processed in the second signal processing path.
Figure 7:
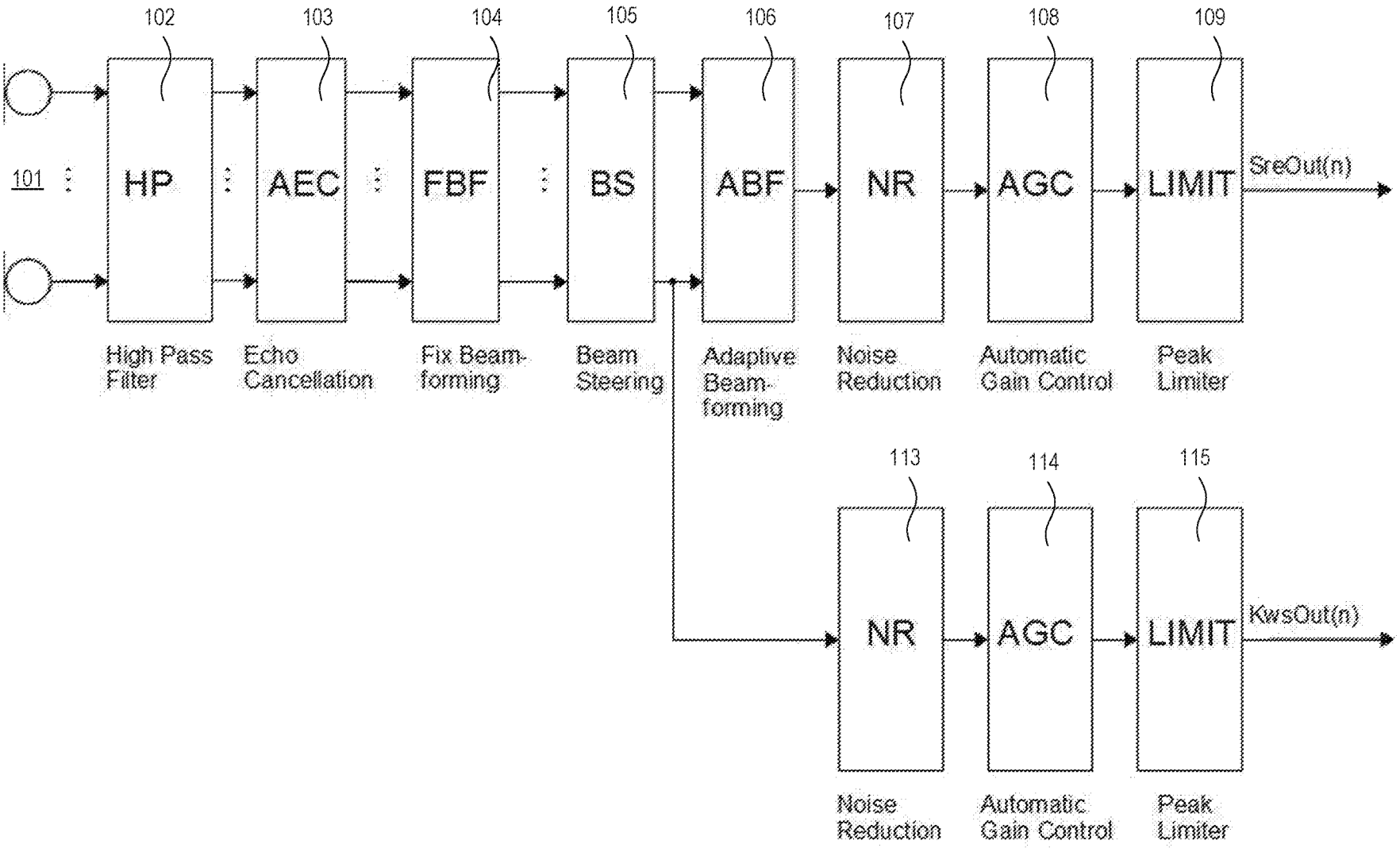
FIG. 7 is a schematic diagram illustrating another exemplary sound capturing system, the system including a common beamsteering block in the first signal processing path and second signal processing path.

Referring to FIG. 4, the system shown in FIG. 3 may be altered by omitting the allpass filter block 201 and connecting the summing block 11 to outputs of the fix beamforming block 104. This allows to further reduce the complexity of the second signal processing path and, thus, the complexity of the whole system. It is not noted that all or only some of the outputs of the fix beamforming block 104 may be connected to the summing block 111. In the exemplary system shown in FIG. 5, only the outputs related to the more negative beams may be summed up by summing block 111. In the exemplary system shown in FIG. 6, the output related to the most negative beam and a number of adjacent outputs (in the example shown 1 at each side) may be summed up by summing block 111. In another alternative, the output of the beam steering block 105 representing the negative beam, i.e., the negative beamforming signal may be directly connected to the noise reduction block 113 while summing block 111 is omitted.

As can be seen from the exemplary systems shown in FIGS. 4-7, multiple options exist for creating a second signal processing path (audio pipeline), e.g., for keyword searching. The options include using one or a sum of several beam related signals or beam signals from the fix beamforming block 104 or the beam steering block 105. For example, the second signal processing path may be fed with signals related to (based on) the negative beam, e.g., the beam pointing in the opposite direction of the positive beam, wherein the positive beam is the beam pointing in the direction of the best signal-to-noise ratio. The positive beam usually addresses the area in the room where the talker is located, but it can be misdirected under certain circumstances, e.g. by an active radio or television set, or by other close-by talkers having a conversation. In this way, a different hemisphere than desired may be covered.

Alternatively or additionally, the negative beam, which is represented by a respective output signal of the beam steering block 105 and which is input to the adaptive beamforming block 106, may be employed, but it has been found that, in order to distinguish between two hemispheres, using just this one (negative) beam may have some drawbacks if the talker is standing 90° off the directions in which the positive and negative beams point, i.e. if the talker is standing perpendicular to the line between the positive beam and negative beam directions. In such a "worst case scenario", it is still likely that, even using a second keyword search based on the signal from the second signal processing path, the "hot word", i.e., the word that is searched for, will be frequently missed.

By taking also the neighboring beams of the negative beam into account, e.g., summing up the signals related to the negative beam and its clock-wise and counter-clock-wise neighbors, this problem can be significantly reduced. For example, if the fix beamforming block delivers eight regularly distributed output beams, the next two neighboring beams are considered (i.e., 5 beams pointing more or less in the direction of the negative beam are summed up). Here situation may be that, if the talker is 90° off the line between the positive beam and negative beam, too much speech energy may leak into the positive beam, which may deteriorate the keyword search performance. Alternatively, summing up all beams and using the sum signal as signal for the second signal processing path may also be employed with satisfying results.

More than two keyword search processes may be run in parallel in order to increase the likelihood to pick-up the hot word even under adverse environmental conditions as described above. For example, four separate keyword search processes may be conducted with one beam for each quadrant out of the eight of the fix beamforming blocks to cover each of those quadrants. Once the keyword search has spotted the hot word, the direction (e.g. the hemisphere, respectively the quadrant) from which the hot word originates can be determined in order to let the positive beam point in this direction and, optionally, stay pointing (freeze) in this direction until the current request to the speech recognition engine is finished.

For example, by way of an additional (virtual) omnidirectional microphone arrangement that may include one or more individual microphones (e.g., an array, particularly a pre-existing array) with a flat magnitude frequency response almost independent of the angle of incidence and with best possible noise behavior, the performance of a key word system (KWS) and/or a hands free system (HFS) can be further enhanced. The systems and methods described above are simple but effective and as such may only demand a minimum of additional memory and/or processing load to create a second audio pipeline useful in avoiding detection losses of spoken key words.

A block is understood to be a hardware system or an element thereof with at least one of: a processing unit executing software and a dedicated circuit structure for implementing a respective desired signal transferring or processing function. Thus, parts or all of the sound capturing system may be implemented as software and firmware executed by a processor or a programmable digital circuit. It is recognized that any sound capturing system as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any sound capturing system as disclosed may utilize any one or more microprocessors to execute a computer-program that is embodied in a non-transitory computer readable medium that is programmed to perform any number of the functions as disclosed. Further, any controller as provided herein includes a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A sound capturing system comprising:

a first signal processing path configured to apply a far-field microphone functionality based on a multiplicity of first microphone signals and to provide a first output signal to a speech processing arrangement; and a second signal processing path configured to apply a less directional microphone functionality than the far-field microphone functionality based on one or more second microphone signals and to provide a second output signal to the speech processing arrangement;

wherein the first signal processing path comprises:

a multi-channel acoustic echo canceling block comprising a multiplicity of acoustic echo cancelers and configured to receive the multiplicity of first microphone signals;

a multi-channel fix beamforming block comprising a multiplicity of fix beamformers and operatively connected downstream of the multi-channel acoustic echo canceling block;

a beam steering block operatively connected downstream of the multi-channel fix beamforming block and configured to provide at least one fix-beam signal; and an adaptive beamforming block operatively connected downstream of the beam steering block and configured to provide a directional beam signal steered towards a target position.

2. The system of claim 1, wherein the first signal processing path further comprises at least one of:

a first noise reduction block operatively connected downstream of the adaptive beamforming block and configured to remove noise from the beam signal provided by the adaptive beamforming block;

a first automatic gain control block operatively connected downstream of the adaptive beamforming block and configured to provide a first automatic gain control output signal with a controlled signal amplitude; and a first limiter block operatively connected downstream of the adaptive beamforming block and configured to provide a first limiter output signal with a signal amplitude that is under a predetermined value.

3. The system of claim 1, wherein the beam steering block is further configured to provide a positive fix-beam signal and a negative fix-beam signal, the positive fix-beam signal representing a beam pointing in a direction in a room with currently a highest signal-to-noise ratio and the negative fix-beam signal representing a beam pointing in a direction in a room with currently a lowest signal-to-noise ratio.

4. The system of claim 1, wherein the beam steering block is further configured to provide a positive fix-beam signal and a negative fix-beam signal, the positive fix-beam signal representing a beam pointing in a direction in a room with currently a highest signal-to-noise ratio and the negative fix-beam signal representing a beam pointing in an opposite direction.

5. A sound capturing system comprising:

a first signal processing path configured to apply a far-field microphone functionality based on a multiplicity of first microphone signals and to provide a first output signal to a speech processing arrangement;

a second signal processing path configured to apply a less directional microphone functionality than the far-field microphone functionality based on one or more second microphone signals and to provide a second output signal to the speech processing arrangement; and a microphone array, the microphone array comprising a multiplicity of microphones that provides at least one of the multiplicity of first microphone signals and the one or more second microphone signals;

wherein the second signal processing path comprises:

a multi-channel delay block comprising a multiplicity of delays and connected to the microphone array or a high-pass filter block;

a first summing block operatively connected downstream of the multi-channel delay block and configured to sum up delayed filtered or unfiltered multiplicity of second microphone signals to provide a sum signal; and a first single-channel acoustic echo canceling block comprising an acoustic echo canceler, and configured to receive the sum signal and to provide a less directional signal.

6. The system of claim 5, the system further comprising a multi-channel delay calculation block, wherein:

a beam steering block is further configured to provide a delay steering signal;

the multi-channel delay block is further configured to provide a multiplicity of controllable delays; and the multi-channel delay calculation block is configured to control the multiplicity of controllable delays based on the delay steering signal from the beam steering block.

7. The system of claim 6, wherein the multiplicity of controllable delays comprises fractional delays.

8. The system of claim 5, wherein the second signal processing path comprises:

a first multi-channel allpass filter block comprising a multiplicity of allpass filters and operatively connected to the microphone array or the high-pass filter block;

a second summing block operatively connected downstream of the multi-channel delay block and configured to sum up delayed filtered or unfiltered multiplicity of second microphone signals to provide a second sum signal; and a second single-channel acoustic echo canceling block comprising a second acoustic echo canceler, and configured to receive the sum signal and to provide the less directional signal.

9. The system of claim 8, wherein the first multi-channel allpass filter block comprises allpass filters with randomly distributed cut-off frequencies that are arranged around a notch in a magnitude frequency response of each of the sum signals.

10. The system of claim 5, wherein the second signal processing path further comprises at least one of:

a noise reduction block operatively connected downstream of the first summing block and configured to remove noise from the sum signal provided by the first summing block;

an automatic gain control block operatively connected downstream of the first summing block and configured to provide a second automatic gain control output signal with a controlled signal amplitude; and a limiter block operatively connected downstream of the first summing block and configured to provide a second limiter output signal with a signal amplitude that is equal to or below a predetermined value.

11. A sound capturing method comprising:

applying a far-field microphone functionality to a multiplicity of first microphone signals to provide a first output signal for speech processing; and applying a less directional microphone functionality than the far-field microphone functionality to one or more second microphone signals to provide a second output signal for speech processing;

wherein applying the far-field microphone functionality comprises:

multi-channel acoustic echo canceling with a multiplicity of acoustic echo cancelers based on a filtered or unfiltered multiplicity of first microphone signals, wherein the filtered multiplicity of first microphone signals is filtered by a high-pass filter;

multi-channel fix beamforming with a multiplicity of fix beamformers downstream of the multi-channel acoustic echo canceling;

beam steering downstream of the multi-channel fix beamforming to provide at least one fix-beam signal; and adaptive beamforming downstream of the beam steering to provide a directional beam signal steered to a target position; and wherein the beam steering provides a positive fix-beam signal and a negative fix-beam signal, the positive fix-beam signal representing a beam pointing in a direction in a room with currently a highest signal-to-noise ratio and the negative fix-beam signal representing a beam pointing in a direction in a room with currently a lowest signal-to-noise ratio.

12. The method of claim 11, further comprising multi-channel high-pass filtering of at least one of the multiplicity of first microphone signals and the one or more second microphone signals before at least one of applying the far-field microphone functionality and applying the less directional microphone functionality.

13. The method of claim 11, further comprising providing at least one of the multiplicity of first microphone signals and the one or more second microphone signals with a microphone array, the microphone array comprising a multiplicity of microphones.

14. The method of claim 11, wherein applying the less directional microphone functionality comprises:

multi-channel delaying with a multiplicity of delays the one or more second microphone signals;

first summing downstream of the multi-channel delaying configured to sum up a delayed filtered or unfiltered multiplicity of second microphone signals to provide a sum signal, wherein the filtered multiplicity of second microphone signals is filtered using a high pass filter; and first single-channel acoustic echo canceling with an acoustic echo canceler based on the sum signal to provide a less directional signal.

15. The method of claim 14, wherein the multiplicity of delays comprises fractional delays.

16. The method of claim 14, wherein the method further comprises delay calculation, wherein:

the beam steering is further configured to provide a delay steering signal;

the multi-channel delaying is further configured to provide a multiplicity of controllable delays; and the delay calculation is configured to control the multiplicity of controllable delays based on the delay steering signal from the beam steering.

17. The method of claim 14, wherein applying the less directional microphone functionality comprises:

first multi-channel allpass filtering with a multiplicity of allpass filters of the filtered or unfiltered multiplicity of second microphone signals;

second summing operatively downstream of the multi-channel delaying to sum up the delayed filtered or unfiltered multiplicity of second microphone signals to provide a second sum signal; and second single-channel acoustic echo canceling with a second acoustic echo canceler based on the second sum signal to provide the less directional signal.

18. The method of claim 17, wherein applying the less directional microphone functionality comprises:

second multi-channel allpass filtering with a second multiplicity of allpass filters downstream of the multi-channel acoustic echo canceling; and second summing of the delayed filtered or unfiltered multiplicity of second microphone signals downstream of the multi-channel delaying to provide the second sum signal.

19. The method of claim 18, wherein at least one of the first multi-channel allpass filtering and the second multi-channel allpass filtering comprises allpass filtering with randomly distributed cut-off frequencies that are arranged around a notch in a resulting magnitude frequency response.

20. The method of claim 14, wherein applying the less directional microphone functionality further comprises at least one of:

noise reduction downstream of the first or a second summing to remove noise from the sum signal provided by the first or the second summing;

automatic gain control downstream of the second summing to provide a second automatic gain control output signal with a controlled signal amplitude; and a limiting downstream of the second summing to provide a limited output signal with a signal amplitude that is under a predetermined value.

* * * * *